US005152802A

United States Patent [19]

Berger et al.

[11] Patent Number: 5,152,802

[45] Date of Patent: Oct. 6, 1992

[54] FOUR COMPONENT ANIONIC AND NON-IONIC SURFACTANT COMPOSITION FOR SINGLE BATH AND SINGLE STAGE DYEING OF TEXTILE FIBERS

[75] Inventors: Faize Berger, Duesseldorf; Klaus Becker, Monheim-Baumberg; Christa Hartschen, Krefeld; Bernd Wahle, Kaarst; Gilbert Schenker, Erkrath; Bernd-Dieter Baehr, Neuss, all of Fed. Rep. of Germany

[73] Assignee: Henkel Kommanditgesellschaft auf Aktien, Duesseldorf, Fed. Rep. of Germany

[21] Appl. No.: 741,437

[22] PCT Filed: Feb. 1, 1990

[86] PCT No.: PCT/EP90/00177

§ 371 Date: Aug. 9, 1991

§ 102(e) Date: Aug. 9, 1991

[87] PCT Pub. No.: WO90/09479

PCT Pub. Date: Aug. 23, 1990

[30] Foreign Application Priority Data

Feb. 10, 1989 [DE] Fed. Rep. of Germany ..... 3903926

[51] Int. Cl.[5] ..... C09B 67/00; D06P 1/61; D06P 3/60

[52] U.S. Cl. ..... 8/587; 8/611; 8/904; 8/918; 252/8.7; 252/8.9; 252/551

[58] Field of Search ..... 8/587, 611; 252/8.7, 252/8.9

[56] References Cited

U.S. PATENT DOCUMENTS

| | | | |
|---|---|---|---|
| 4,123,378 | 10/1978 | Abel et al. | 252/171 |
| 4,251,383 | 2/1981 | Kemp | 252/118 |
| 4,421,666 | 12/1983 | Hempel et al. | 252/140 |
| 4,438,009 | 3/1984 | Brusky et al. | 252/90 |
| 4,861,516 | 8/1989 | Kurzendoerfer et al. | 252/531 |
| 4,894,183 | 1/1990 | Tpofl | 252/358 |
| 4,931,218 | 6/1990 | Schenker et al. | 252/551 |
| 5,074,888 | 12/1991 | Topfl et al. | 8/543 |

FOREIGN PATENT DOCUMENTS 1355102 5/1974 United Kingdom .

*Primary Examiner*—A. Lionel Clingman

*Attorney, Agent, or Firm*—Ernest G. Szoke; Wayne C. Jaeschke; Real J. Grandmaison

[57] ABSTRACT

A dyeing aid composition containing 1 to 60% by weight of a surfactant selected from (a) $C_{8-24}$ alkyl or alkenyl alcohol sulfate, $C_{14-18}$ alkane sulfonate and $C_{10-14}$ alkyl benzenesulfonate; (b) castor oil containing 20–50 mols ethylene oxide, alkoxylated $C_{8-24}$ alkyl or alkenyl alcohols, and alkoxylated $C_{8-12}$ alkylphenols; from about 1 to about 25% by weight of sulfated hydroxyalkyl alkylpolyalkylene glycol ether corresponding to formula I $$R-O-(C_nH_{2n}O)_x-CH_2-\overset{\overset{\displaystyle OSO_3M}{|}}{CH}-R^1 \qquad (I)$$

in which R is a $C_{1-6}$ alkyl radical, $R^1$ is a $C_{6-8}$ alkyl radical, M is an alkali metal or, ammonium cation, n=2 or 3 and x is a number of about 2 to about 10; and from about 1 to about 30% by weight of $C_{2-12}$ alkyl alcohol; with the proviso that the ratio by weight of surfactants (a) to surfactants (b) is from about 5:1 to about 1:5, the ratio by weight of surfactants (a) and (b) to sulfatized hydroxyalkyl alkylpolyalkylene glycol ether is from about 1:1 to about 4:1 and the ratio by weight of surfactants (a) and (b) and sulfatized hydroxyalkyl polyalkyene glycol ether to alkyl alcohol is from about 1:1 to about 5:1.

10 Claims, No Drawings

FOUR COMPONENT ANIONIC AND NON-IONIC SURFACTANT COMPOSITION FOR SINGLE BATH AND SINGLE STAGE DYEING OF TEXTILE FIBERS

BACKGROUND OF THE INVENTION

1. Field of the Invention

This invention relates to dyeing aids and to a process for the single-bath, single-stage dyeing of textile fibers.

2. Discussion of Related Art

Cotton contains natural impurities, for example waxes, wax-like substances, proteins, seed shells, fruit husks and pectins and also impurities which are applied as foreign substances in the course of processing, for example paraffins and/or mineral oils. The impurities in wool, regenerated fibers, such as viscose rayon, and synthetic fibers, such as polyester and polyamide, emanate from the treatment of these materials with finishes (Chwala/Anger: "Handbuch der Textilhilfsmittel", pages 526–528, 537, 558 et seq., Verlag Chemie Weinheim, 1977). To obtain uniformly dyed textile fibers, particularly cellulose-containing textile fibers, the textile material is normally subjected to a pretreatment. The object of the pretreatment is to remove the impurities mentioned by way of example above as completely as possible from the fibers in order thus to provide the fibers with the relatively high degree of hydrophilicity and absorbency required for the subsequent finishing processes. In dyeing processes above all, inadequate hydrophilic properties and inadequate absorbency of the textile material result as early as the dye absorption phase in uneven dyeing which is very difficult or impossible to correct.

However, the pretreatment is attended by the disadvantage that it has to be carried out in several stages. Accordingly, to shorten the processes involved in the dyeing of textiles, processes have recently been developed which eliminate the need for the separate pretreatment step (Chwala/Anger: "Handbuch der Textilhilfsmittel", pages 528–529, Verlag Chemie Weinheim, 1977). Single-bath, single-stage dyeing is one such process. In this process the textile material is pretreated and dyed in a single stage. The baths contain the chemicals required for the pretreatment, such as wetting agents, detergents, dispersants, leveling agents and/or alkalis, and also dyes. The single-bath/single-stage dyeing process described in DE 36 43 752 for mixtures of polyester fibers and cellulose fibers dyeable in the absence of carriers is carried out in the presence of dispersion and reactive dyes and, optionally, auxiliaries at pH values of 6 to 8.5 and at temperatures of from 90° to 105° C.

However, the stringent requirements in regard to level dyeing, depth of color and fastness of the textile material often cannot be satisfactorily met by the known single-bath, single-stage dyeing processes. Accordingly, the problem addressed by the present invention was to develop dyeing aids which, used in single-bath single-stage dyeing processes, would produce uniform and brilliant colors on the textile material. In addition, the performance characteristics of the dyed fibers, such as fastness to light, fastness to rubbing and wet fastness values, would not be adversely affected by the use of such aids.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that the stringent requirements which the dyeing properties of textile fibers and, in particular, cellulose-containing textile fibers have to meet are satisfied by mixtures containing 1. $C_{8-24}$ alkyl and/or $C_{8-24}$ alkenyl alcohol sulfates and/or $C_{14-18}$ alkane sulfonates and/or $C_{10-14}$ alkyl benzene sulfonates, 2. castor oil containing 20 to 50 mol ethylene oxide and/or alkoxylated $C_{8-24}$ alkyl and/or $C_{8-24}$ alkenyl alcohols and/or alkoxylated $C_{8-12}$ alkylphenols, 3. sulfated hydroxyalkyl alkylpolyalkylene glycol ethers and 4. $C_{2-12}$ alkyl alcohols in certain quantities and ratios by weight.

Accordingly, the present invention relates to dyeing aids containing anionic and nonionic surfactants, characterized in that they contain 1 to 60% by weight surfactants from the groups a) $C_{8-24}$ alkyl and/or $C_{8-24}$ alkenyl alcohol sulfates and/or $C_{14-18}$ alkane sulfonates and/or $C_{10-14}$ alkyl benzene sulfonates in the form of their alkali, ammonium and/or amine salts and b) castor oil containing 20 to 50 mol ethylene oxide and/or alkoxylated $C_{8-24}$ alkyl and/or $C_{8-24}$ alkenyl alcohols and/or alkoxylated $C_{8-12}$ alkylphenols, 1 to 25% by weight sulfated hydroxyalkyl alkylpolyalkylene glycol ethers corresponding to general formula I $$R-O(C_nH_{2n}O)_x-CH_2-\overset{\overset{\displaystyle OSO_3M}{|}}{CH}-R^1$$

in which R is a $C_{1-6}$ alkyl radical, R is a $C_{6-18}$ alkyl radical, M is an alkali metal or ammonium cation, n=2 or 3 and x is a number of 2 to 10, and 1 to 30% by weight $C_{2-12}$ alkyl alcohols, with the proviso that the ratio by weight of surfactants a) to surfactants b) is from 5:1 to 1:5, the ratio by weight of surfactants a) and b) to sulfated hydroxyalkyl alkylpolyalkylene glycol ethers is from 1:1 to 4:1 and the ratio by weight of surfactants a) and b) and sulfated hydroxyalkyl alkylpolyalkylene glycol ethers to alkyl alcohols is from 1:1 to 5:1.

The dyeing aids according to the invention preferably contain 1 to 40% by weight surfactants a) and b), 1 to 20% by weight sulfated hydroxyalkyl alkylpolyalkylene glycol ethers corresponding to general formula I and 1 to 30% by weight $C_{2-12}$ alkyl alcohols.

The alkyl and/or alkenyl alcohol sulfates are produced in the form of their alkali, ammonium and/or amine salts in known manner by sulfatization of the corresponding alkyl and/or alkenyl alcohols with chlorosulfonic acid or sulfur trioxide. The resulting sulfuric acid semiesters of the alcohols are then neutralized with, for example, alkali hydroxide, such as sodium hydroxide, ammonia or alkanolamines, such as monoethanolamine or triethanolamine (Winnacker-Küchler in "Chemische Technologie", Vol. 7, pages 120–123, Carl Hanser Verlag, München-Wien (1986)). The educts alkyl and/or alkenyl alcohols may be linear or branched, of natural or synthetic origin and contain 8 to 24 carbon atoms and preferably 12 to 18 carbon atoms. Examples of alkyl and/or alkenyl alcohols are octyl, decyl, lauryl, myristyl, cetyl, stearyl, oleyl, behenyl alcohol and mixtures of these alcohols. Lauryl, myristyl, cetyl or stearyl alcohol, mixtures of these alcohols or alcohol mixtures with predominantly $C_{12-18}$ alkyl and/or $C_{12-18}$ alkenyl alcohols, for example coconut oil fatty alcohol or tallow fatty alcohol, are preferably used.

On an industrial scale, alkali, ammonium and/or amine salts of $C_{14-18}$ alkanesulfonates may be obtained by reaction of linear paraffins with, for example, $SO_2$ and oxygen in the presence of radical formers, such as ozone, organic peroxides or UV light (Winnacker-Küchler in "Chemische Technologie", 4th Edition, Vol. 7, pages 114–116, Carl Hanser Verlag, München-Wien (1986)).

$C_{10-14}$ alkyl benzene sulfonates in the form of their alkali, ammonium and/or amine salts may be produced by reaction of $C_{10-14}$ alkyl benzenes with sulfonating agents, such as $SO_3$/air mixtures, $SO_3$/nitrogen mixtures, sulfuric acid or oleum, using known industrial processes "Winnacker-Küchler in Chemische Technologie", 4th Edition, Vol. 7, pages 111–114, Carl Hanser Verlag, München-Wien (1986)).

Castor oil containing 20 to 50 mol ethylene oxide, alkoxylated $C_{8-24}$ alkyl and/or $C_{8-24}$ alkenyl alcohols and alkoxylated $C_{8-12}$ alkylphenols are produced by alkoxylation of castor oil or linear and/or branched alkyl and/or alkenyl alcohols of natural and/or synthetic origin or alkylphenols with ethylene oxide and/or propylene oxide using known industrial processes (see for example "Chemische Technologie", Vol. 7, pages 131–132, Carl Hanser Verlag, München-Wien (1986)). The average degree of alkoxylation of the alkoxylates obtained, which corresponds to the molar quantity of the added alkylene oxides, is preferably from 30 to 50 in the case of castor oil, preferably from 3 to 10 and more preferably from 4 to 8 in the case of alkyl and/or alkenyl alcohols and preferably from 1 to 20 in the case of the alkylphenols. Suitable alkyl and/or alkenyl alcohols containing 8 to 24 and preferably 12 to 18 carbon atoms are the alcohols and alcohol mixtures mentioned above.

Sulfated hydroxyalkyl alkylpolyalkylene glycol ethers may be obtained in accordance with EP 299 370 by sulfatization of hydroxyalkyl alkylpolyalkylene glycol ethers corresponding to general formula II $$R-O(C_nH_{2n}O)_x-CH_2-\overset{\overset{\displaystyle OH}{|}}{CH}-R^1$$

with chlorosulfonic acid or $SO_3$/inert gas mixtures and subsequent neutralization, for example with alkali hydroxides, such as sodium hydroxide, ammonia or amines, such as $C_{1-4}$ alkylamines or triethanolamine. The ethers corresponding to general formula II may be obtained in accordance with EP 299 370 by reaction of epoxides corresponding to general formula III

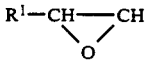

with alkoxylated linear or branched alkyl alcohols corresponding to general formula IV $$R-O-(C_nH_{2n}O)_x-H$$

in the presence of catalysts, for example sodium methylate, at temperatures in the range from 100° to 180° C. and preferably at temperatures in the range from 150° to 160° C. Sulfated hydroxyalkyl alkylpolyalkylene glycol ethers corresponding to general formula I, in which R is a linear or branched $C_{2-5}$ alkyl radical, $R^1$ is a linear or branched $C_{8-16}$ alkyl radical, M is an alkali metal cation, n=2 and x is a number of 2 to 5, are preferably used.

The fourth component of the mixtures according to the invention, namely the $C_{2-12}$ alkyl alcohols, may be linear or branched and of natural or synthetic origin. $C_{6-10}$ alkyl alcohols, for example 2-ethyl hexanol, n-octanol and/or n-decanol, are preferably used.

The present invention also relates to a process for the single-bath, single-stage dyeing of textile fibers in the presence of anionic and/or nonionic surfactants, characterized in that the textile fibers are treated at temperatures of 20° to 95° C. with aqueous dye liquors containing per liter liquor

| | |
|---|---|
| 0.1–2.0 g | surfactants from the groups<br>a) $C_{8-24}$ alkyl and/or $C_{8-24}$ alkenyl alcohol sulfates and/or $C_{14-18}$ alkane sulfonates and/or $C_{10-14}$ alkyl benzene sulfonates in the form of their alkali, ammonium and/or amine salts and<br>b) castor oil containing 20 to 50 mol ethylene oxide and/or alkoxylated $C_{8-24}$ alkyl and/or $C_{8-24}$ alkenyl alcohols and/or alkoxylated $C_{8-12}$ alkylphenols, |
| 0.05–1.0 g | sulfatedhydroxyalkylalkylpolyalkylene glycol ethers corresponding to general formula I<br>$R-O(C_nH_{2n}O)_x-CH_2-\overset{\overset{\displaystyle OSO_3M}{\vert}}{CH}-R^1$<br>in which R is a $C_{1-6}$ alkyl radical, $R^1$ is a $C_{6-18}$ alkyl radical, M is an alkali metal or ammonium cation, n = 2 or 3 and x is a number of 2 to 10, and |
| 0.1–2.0 g | $C_{2-12}$ alkyl alcohols, |

the ratio by weight of surfactants a) to surfactants b) being from 5:1 to 1:5, the ratio by weight of surfactants a) and b) to sulfated hydroxylalkyl alkylpolyalkylene glyol ethers being from 1:1 to 4:1 and the ratio by weight of surfactants a) and b) and sulfated hydroxylalkyl alkylpolyalkylene glycol ethers to alkyl alcohols being from 1:1 to 5:1, and on completion of dyeing are aftertreated in known manner at temperatures in the range from 80° to 100° C.

Preferably, from 0.3 to 1.2 g surfactants from groups a) and b), from 0.1 to 0.6 g sulfated hydroxyalkyl alkylpolyalkylene glycol ethers and from 0.2 to 0.6 g $C_{2-12}$ alkyl alcohols are used per liter dye liquor.

In addition to the mixtures according to the invention, the aqueous dye liquors contain from 0.5 to 5.0% by weight dyes, based on the weight of the textile material. Reactive dyes, substantive dyes, vat dyes, dispersion dyes, diazo dyes, sulfur dyes, acid dyes and/or metal complex dyes and/or pigments are used as dyes, depending on the textile fibers to be treated. The aqueous dye liquors contain aliphatic $C_{8-24}$ carboxylic acids, such as hydrogenated tallow fatty acid and/or coconut oil fatty acid, $C_{8-24}$ alkylamines, such as tallow amine, foam inhibitors, for example based on mineral oil or silicone, as optional constituents in a total quantity of 0.01 to 1.0 g per liter dye liquor. Textile fibers, for example of cotton, viscose, wool, cotton/polyester blends or cotton/polyamide blends, which are present for example as woven fabrics, knitted fabrics or yarns, are dyed by the extraction process in which the textile material is contacted with the aqueous dye liquors at temperatures in the range from 20° to 45° C. The liquor ratio is between 1:5 and 1:30 and preferably between 1:10 and 1:20. Electrolytes, for example Glauber's salt and/or sodium chloride in quantities of 30 to 80 g per liter liquor and sodium carbonate or NaOH in quantities of 2 to 20 g per liter liquor, are then added to the dye liquors, preferably in several portions, at the same temperature or at higher temperatures. After dyeing, the textile fibers are aftertreated in known manner at temperatures of 25° to 98° C. to improve their performance characteristics, the aftertreatment comprising adding aftertreatment preparations, such as Locanit®B, a product of Henkel KGaA, detergents and/or cationic post-setting agents to the aqueous liquors in quantities of 0.5 to 1.5 g per liter. After rinsing with water, the fibers are dried at temperatures of 50° to 150° C.

The mixtures according to the invention, which are used in aqueous dye liquors, show good electrolyte compatibility and produce excellent depth and level of color on cellulose-containing textile fibers combined with good performance characteristics, such as fastness to light or wet fastness values.

EXAMPLES

Example 1

In a jet dyer of the type made by Mathis, Switzerland, raw cotton knitted fabric (average fat content: 0.45% by weight) was treated at 45° C. with an aqueous dye liquor containing 1% by weight C.I. Reactive Blue 71 (Procionlürkis H-A, a product of ICI), based on the weight of the raw cotton knitted fabric, and 1 g of the mixture according to the invention per liter liquor. The liquor ratio was 1:17, based on the weight of the fabric. The temperature was then increased and quantities of 25 g/l sodium chloride were added at 50° C., 60° C. and 70° C. 10 g/l soda was added twice at 85° C. The fabric was then aftertreated with new liquor containing 1 g/l liquor Locanit®B, a product of Henkel KGaA, at a temperature of 95° C. After rinsing with water and tumble-drying at 60° C., the fastness to rubbing of the dyed knitted cotton fabric obtained was determined in accordance with DIN 54 021 and its residual fat content was determined by extraction with petroleum ether in accordance with DIN 54 278, Part 1. The evenness of dyeing was visually evaluated by three people on a piece of fabric measuring approx. 2 $m^2$ (1=very good, 6=very poor). The results are shown in Table 1.

TABLE 1

| Mixture used[1] | Residual fat content in % by weight | Evenness of dyeing | Fastness to rubbing (DIN 54 021) Dry | Wet |
|---|---|---|---|---|
| Mixture according to the invention | 0.02 | 1–2 | 5 | 3 |
| Comparison mixture | | | | |
| 1 | 0.31 | 5–6 | 5 | 3 |
| 2 | 0.06 | 6 | 5 | 2–3 |
| 3 | 0.37 | 4–5 | 5 | 2–3 |

Composition of the Mixtures Used

Mixture According to the Invention

| | |
|---|---|
| 23.25% by weight | $C_{12-18}$ fatty alcohol sulfate, sodium salt (35% by weight aqueous solution) |
| 23.25% by weight | castor oil.40 EO |
| 23.25% by weight | sulfated hydroxyalkyl alkylpolyethylene glycol ether of general formula I (R = n-butyl, $R^1$ = n-dodecyl, x = 2.5; 48% by weight aqueous solution) |
| 23.25% by weight | 2-ethyl hexanol |
| 7% by weight | Foamaster ®340 (mineral oil foam inhibitor, Henkel KGaA) |

Comparison Mixture 1 corresponds to the mixture according to the invention without the sulfated hydroxyalkyl alkylpolyethylene glycol ether: 7% by weight Foamaster ®340 and 31% by weight of each of the other components Comparison Mixture 2

| | |
|---|---|
| 93% by weight | sulfated hydroxyalkyl alkylpolyethylene glycol ether of general formula I (R = n-butyl, $R^1$ = n-dodecyl, x = 2.5; 48% by weight aqueous solution) |
| 7% by weight | Foamaster ®340 |

Comparison Mixture 3 without surfactants, sulfated hydroxyalkyl alkylpolyethylene glycol ether, alcohol and foam inhibitor.

Example 2

In the same jet dyer as in Example 1, knitted cotton fabric (average fat content: 0.45% by weight), partly soiled with Parffinum durum (softening point 62° C.; partial paraffin coating: 1.2 g distributed over 10 patches each with an area of approx. 10 $cm^2$) was treated at 40° C. with an aqueous dye liquor containing 2% by weight C.I. Reactive Blue 114 (Levafixbrilliantblau E-BRA, a product of Bayer AG), based on the weight of the fabric, and 1 g/l of the mixture according to the invention. The liquor ratio was 1:15. 50 g/l Glauber's salt in two portions and 15 g/l calcined soda in two portions were then added to the aqueous dye liquor. After dyeing for 40 minutes, the fabric was aftertreated at 95° C. by addition of 1 g/l Locanit ®B to the aqueous dye liquor. After rinsing and tumble-drying at 60° C., the dye finish was evaluated in the same way as in Example 1. The results are shown in Table 2.

TABLE 2

| Mixture used[2] | Residual fat content in % by weight | Evenness of dyeing | Fastness to rubbing (DIN 54 021) Dry | Wet |
|---|---|---|---|---|
| Mixture according to the invention | 0.15 | 2–3 | 5 | 3–4 |
| Comparison mixture | | | | |
| 1 | 0.23 | 6 | 5 | 3 |
| 2 | 0.19 | 6 | 5 | 3 |
| 3 | 0.39 | 6 | 5 | 3–4 |

2) Composition of the Mixtures Used

Mixture According to the Invention

| | |
|---|---|
| 23.25% by weight | $C_{12-18}$ fatty alcohol sulfate, sodium salt (35% by weight aqueous solution) |
| 23.25% by weight | $C_{16-18}$ fatty alcohol.6 EO |
| 23.25% by weight | sulfated hydroxyalkyl alkylpolyethylene glycol ether of general formula I (R = n-butyl, $R^1$ = n-dodecyl, x = 2.5; 48% by weight aqueous solution) |
| 23.25% by weight | 2-ethyl hexanol |
| 7% by weight | Foamaster ®340 |

Comparison Mixture 1 corresponds to the mixture according to the invention without the sulfated hydroxyalkyl alkylpolyethylene glycol ether: 7% by weight Foamaster ®340 and 31% by weight of each of the other components Comparison Mixture 2

| | |
|---|---|
| 93% by weight | sulfated hydroxyalkyl alkylpolyethylene glycol ether of general formula I (R = n-butyl, $R^1$ = n-dodecyl, x = 2.5; 48% by weight aqueous solution) |
| 7% by weight | Foamaster ®340 |

Comparison Mixture 3 without surfactants, sulfated hydroxyalkyl alkylpolyethylene glycol ether, alcohol and foam inhibitor.

We claim:

1. A dyeing aid composition containing anionic and nonionic surfactants, comprising from about 1 to about 60% by weight of surfactants selected from the group consisting of (a) $C_{8-24}$ alkyl or $C_{8-24}$ alkenyl alcohol sulfates, $C_{14-18}$ alkane sulfonates and $C_{10-14}$ alkyl benzene sulfonates in the form of their alkali metal, ammonium or amine salts, and (b) castor oil containing about 20 to about 50 mols of ethylene oxide, alkoxylated $C_{8-24}$ alkyl or alkenyl alcohols, and alkoxylated $C_{8-12}$ alkylphenols; from about 1 to about 25% by weight of sulfated hydroxyalkyl alkylpolyalkylene glycol ether corresponding to formula I $$R-O-(C_nH_{2n}O)_x-CH_2-\underset{}{\overset{OSO_3M}{\overset{|}{CH}}}-R^1 \quad (I)$$

in which R is a $C_{1-6}$ alkyl radical, $R^1$ is a $C_{6-18}$ alkyl radical, M is an alkali metal or ammonium cation, n=2 or 3 and x is a number of about 2 to about 10; and from about 1 to about 30% by weight of $C_{2-12}$ alkyl alcohol; with the proviso that the ratio by weight of surfactants (a) to surfactants (b) is from about 5:1 to about 1:5, the ratio by weight of surfactants (a) and (b) to sulfated hydroxyalkyl alkylpolyalkylene glycol ether is from about 1:1 to about 4:1 and the ratio by weight of surfactants (a) and (b) and sulfated hydroxyalkyl polyalkylene glycol ether to alkyl alcohol is from about 1:1 to about 5:1.

2. A dyeing aid composition as in claim 1 comprising from about 1 to about 40% by weight of said surfactants (a) and (b), from about 1 to about 20% by weight of said sulfated hydroxyalkyl alkylpolyalkylene glycol ether, and from about 1 to about 30% by weight of said $C_{2-12}$ alkyl alcohol.

3. A dyeing aid composition as in claim 1 wherein said surfactants (a) are selected from the group consisting of $C_{12-18}$ alkyl or alkenyl alcohol sulfates in the form of their alkali metal or ammonium salts, and said surfactants (b) are selected from the group consisting of castor oil ethoxylated with about 30 to about 50 mols of ethylene oxide, a $C_{12-18}$ alkyl or alkenyl alcohol ethoxylated with about 3 to about 10 mols of ethylene oxide, and a $C_{8-12}$ alkylphenol ethoxylated with about 1 to about 20 mols of ethylene oxide.

4. A dyeing aid composition as in claim 1 wherein in said sulfated hydroxylakyl alkylpolyalkylene glycol ether corresponding to formula I, R is a $C_{2-5}$ alkyl radical, $R^1$ is a $C_{8-16}$ alkyl radical, M is an alkali metal cation, N=2 and x is a number of about 2 and about 5.

5. A dyeing aid composition as in claim 1 containing a $C_{6-10}$ alkyl alcohol.

6. A process for the single bath, single-stage dyeing of textile fibers in the presence of anionic and nonionic surfactants, comprising contacting said textile fibers at a temperature of from about 20 to about 95° C. with an aqueous dye liquor containing per liter of liquor, from about 0.1 to about 2.0 g of surfactants selected from the group consisting of (a) $C_{8-24}$ alkyl or $C_{8-24}$ alkenyl alcohol sulfates, $C_{14-18}$ alkane sulfonates, and $C_{10-14}$ alkyl benzene sulfonates in the form of their alkali metal, ammonium or amine salts, and (b) castor oil containing about 20 to about 50 mols of ethylene oxide, alkoxylated $C_{8-24}$ alkyl or alkenyl alcohols, and alkoxylated $C_{8-12}$ alkylphenols; from about 0.05 to about 1.0 g sulfated hydroxyalkyl alkylpolyalkylene glycol ether corresponding to formula I $$R-O-(C_nH_{2n}O)_x-CH_2-\overset{OSO_3M}{\overset{|}{CH}}-R^1 \quad (I)$$

in which R is a $C_{1-6}$ alkyl radical, $R^1$ is a $C_{6-18}$ alkyl radical, M is an alkali metal or ammonium cation, n=2 or 3 and x is a number of about 2 to about 10; and from about 0.1 to about 2.0 g of $C_{2-12}$ alkyl alcohol; wherein the ratio by weight of surfactants (a) to surfactants (b) is from about 5:1 to about 1:5, the ratio by weight of surfactants (a) and (b) to sulfated hydroxyalkyl alkylpolyalkylene glycol ether is from about 1:1 to about 4:1 and the ratio by weight of surfactants (a) and (b) and sulfated hydroxyalkyl alkylpolyalkylene glycol ethers to alkyl alcohol is from about 1:1 to about 5:1, and on completion of dyeing said fibers, aftertreating said fibers at a temperature in the range of from about 80° to about 100° C.

7. A process as in claim 6 wherein said aqueous dye liquor contains from about 0.3 to about 1.2 g of said surfactants selected from group (a) and (b), from about 0.1 to about 0.6 g of said sulfated hydroxyalkyl polyalkylene glycol ether, and from about 0.2 to about 0.6 g of said $C_{2-12}$ alkyl alcohol per liter of said liquor.

8. A process as in claim 6 wherein said surfactants (a) are selected from the group consisting of $C_{12-18}$ alkyl or $C_{12-18}$ alkenyl alcohol sulfates in the form of their alkali metal or ammonium salts, and said surfactants (b) are selected from the group consisting of castor oils ethoxylated with about 30 to about 50 mols of ethylene oxide, a $C_{12-18}$ alkyl or alkenyl alcohol ethoxylated with about 3 to about 10 mols of ethylene oxide, and a $C_{8-12}$ alkylphenol ethoxylated with about 1 to about 20 mols of ethylene oxide.

9. A process as in claim 6 wherein in said sulfated hydroxyalkyl alkylpolyalkylene glycol ether corresponding to formula I, R is a $C_{2-5}$ alkyl radical, $R^1$ is a $C_{8-16}$ alkyl radical, M is an alkali metal cation, n=2 and x is a number of about 2 to about 5.

10. A process as in claim 6 wherein said aqueous dye liquor contains a $C_{6-10}$ alkyl alcohol.

* * * * *